US006529097B2

(12) United States Patent
Nakaguchi et al.

(10) Patent No.: US 6,529,097 B2
(45) Date of Patent: Mar. 4, 2003

(54) COAXIAL RESONATOR, AND DIELECTRIC FILTER AND DIELECTRIC DUPLEXER COMPRISING SAME

(75) Inventors: Masahisa Nakaguchi, Katano (JP); Takaaki Uchiyama, Higashiosaka (JP)

(73) Assignees: Sanyo Electric Co., Ltd., Moriguchi (JP); Sanyo Electronic Components Co., Ltd., Daito (JP)

( * ) Notice: Subject to any disclaimer, the term of this patent is extended or adjusted under 35 U.S.C. 154(b) by 0 days.

(21) Appl. No.: 09/963,036

(22) Filed: Sep. 26, 2001

(65) Prior Publication Data

US 2002/0101297 A1 Aug. 1, 2002

(30) Foreign Application Priority Data

Jan. 26, 2001 (JP) ..... 2001-18103

(51) Int. Cl.[7] ..... H01P 1/202

(52) U.S. Cl. ..... 333/134; 333/202; 333/206; 333/222; 333/191

(58) Field of Search ..... 333/206, 202, 333/222

(56) References Cited

U.S. PATENT DOCUMENTS 4,567,454 A * 1/1986 Saito ..... 333/206
4,965,537 A * 10/1990 Kommrusch ..... 333/202
5,144,269 A * 9/1992 Itoh ..... 333/206
5,379,011 A * 1/1995 Sokola et al. ..... 333/134
5,602,518 A * 2/1997 Clifford et al. ..... 333/202
5,783,978 A * 7/1998 Noguchi et al. ..... 333/202
5,999,070 A * 12/1999 Endo ..... 333/206
6,188,299 B1 * 2/2001 Kawase et al. ..... 29/840

* cited by examiner

*Primary Examiner*—Michael Tokar
*Assistant Examiner*—Lam T. Mai
(74) *Attorney, Agent, or Firm*—Armstrong, Westerman & Hattori, LLP

(57) ABSTRACT

A coaxial resonator which can be electrically connected to an inductance or similar electric element easily to reduce the number of work steps for mounting and the number of parts, and a dielectric filter and a dielectric duplexer which include a resonator and which can be more compact and installed in a diminished space. The coaxial resonator includes a dielectric block having a through-bore extending through opposite end faces thereof, and a conductor layer formed over an outer peripheral surface of the block except one end face thereof and over a block inner surface defining the through-bore for causing electromagnetic waves to resonate within the dielectric block. A lead-equipped electric element has its lead inserted in and fixed in the through-bore and electrically connected to the conductor layer over the bore-defining inner surface with a braze filler metal or electrically conductive adhesive.

4 Claims, 5 Drawing Sheets

COAXIAL RESONATOR, AND DIELECTRIC FILTER AND DIELECTRIC DUPLEXER COMPRISING SAME

FIELD OF THE INVENTION

The present invention relates to coaxial resonators having a reduced number of components and which can be manufactured by a simplified process, and to dielectric filters and dielectric duplexers including such resonators.

BACKGROUND OF THE INVENTION

As shown in FIG. 8 which is an equivalent circuit diagram of the present invention, dielectric duplexers 40 for use in communications devices for transmitting and receiving high-frequency signals of hundreds of megahertz to several gigahertz comprise a band-reject dielectric filter 42 on the receiving side, and a band-pass dielectric filter 43 on the receiving side which are electrically connected to a common antenna ANT.

The band-reject dielectric filter 42 and the band-pass dielectric filter 43 each include a plurality of coaxial dielectric resonators 11, 11, 11 mounted on an electrically conductive pattern 71 on a substrate 70 and electrically connected together by an inductance L, capacitors C, etc. (see FIG. 9 of the invention). Some of the inductance L and capacitors C in FIG. 9 are formed directly on the pattern 71 on the substrate 70.

The coaxial dielectric resonators to be mounted on the substrate 70 include a ¼ wavelength resonator 11. With reference to FIG. 11, this device comprises a dielectric block 12 having a through- bore 13 extending through opposite end faces thereof, and a conductor layer 14 formed over the outer peripheral surface of the block 12 except one end face thereof and over the block inner surface defining the through-bore 13. This resonator causes electromagnetic waves having a wavelength equal to ¼ of the length of the resonator to resonate within the dielectric block 12.

The resonators 11 mounted on the substrate 70 include one electrically connected in series with an electric element such as an inductance or a capacitor, as indicated at 10 in the equivalent circuit diagram of FIG. 8. The resonator 11 is connected to the electric element 22 conventionally by using a tubular member 90 which is made by shaping a conductive metal into a tubular form as shown in FIG. 10 and which has a tongue 91 projecting from one end of the tubular member The resonator 11 is electrically connected in series with the electric element 22 by inserting the tubular member 90 into the through-bore 13 of the resonator 11, as shown in FIG. 10, mounting the resonator 11 on the substrate 70, and thereafter soldering the tongue 91 of the tubular member 90 to a lead 23 of the electric element 22 as at 93 on a conductive plate 92, as shown in FIG. 11. electric element 22 as at 93 on a conductive plate 92 as shown in FIG. 11.

The electrical connection of the resonator 11 to the inductance or like electric element 22 thus necessitates the tubular member 90 and the conductive plate 92, which therefore increase the number of work steps involved in mounting and the number of parts, while the substrate 70 requires a space for providing the conductive plate 92. Accordingly, difficulties are encountered in making dielectric filters 41 or dielectric duplexers 40 comprising resonators 11 more compact.

An object of the present invention is to provide a coaxial resonator which can be electrically connected to an inductance or like electric element easily to reduce the number of work steps for mounting and the number of parts, and a dielectric filter and a dielectric duplexer which comprise the resonator and which can be compacted and installed in a diminished space.

SUMMARY OF THE INVENTION

To fulfill the above object, the present invention provides a coaxial resonator comprising a dielectric block having a through-bore extending through opposite end faces thereof, and a conductor layer formed over an outer peripheral surface of the block except one end face thereof and over a block inner surface defining the through bore for causing electromagnetic waves to resonate within the dielectric block. A lead-equipped electric element has its lead inserted in the through-bore and electrically connected to the conductor layer over the bore-defining inner surface with a braze filler metal or electrically conductive adhesive, and the lead is fixed in the through-bore.

The present invention provides a dielectric filter including a plurality of coaxial resonators. The coaxial resonator described is used as at least one of these coaxial resonators.

The present invention further provides a dielectric duplexer comprising a band-reject filter for transmitting and a band-pass filter for receiving which are electrically connected to an antenna ANT. The dielectric filter described is used as the band-reject filter and/or the band-pass filter.

The coaxial resonator of the present invention can be electrically connected to the lead of an inductance or like electric element by inserting the lead directly into the through-bore of the resonator and brazing the lead to the bored portion with a braze filler metal. An electrically conductive adhesive can be used in place of the braze filler metal.

The coaxial resonator of the present invention requires none of parts such as a tubular member and conductive plate, thus serving to reduce the number of parts. Because the lead of the electric element is joined to the resonator by direct brazing or using a conductive adhesive, the number of work steps conventionally needed for mounting can be diminished. The reductions in the number of parts and the number of work steps achieve improvements in the reliability of the product.

The dielectric filter and the dielectric duplexer of the present invention include a coaxial resonator, which can be electrically connected directly to the lead-equipped electric element without necessitating a conductive plate or the like. This serves to reduce the number of work steps and the number of parts, further eliminating the need for a space for the provision of the conductive plate. The filter and the duplexer can therefore be made more compact. Because the coaxial resonator of the present invention has an improved reliability as stated above, the filter and the duplexer including the resonator are also improved in reliability.

DETAILED DESCRIPTION OF THE PREFERRED EMBODIMENTS

Figure 1:
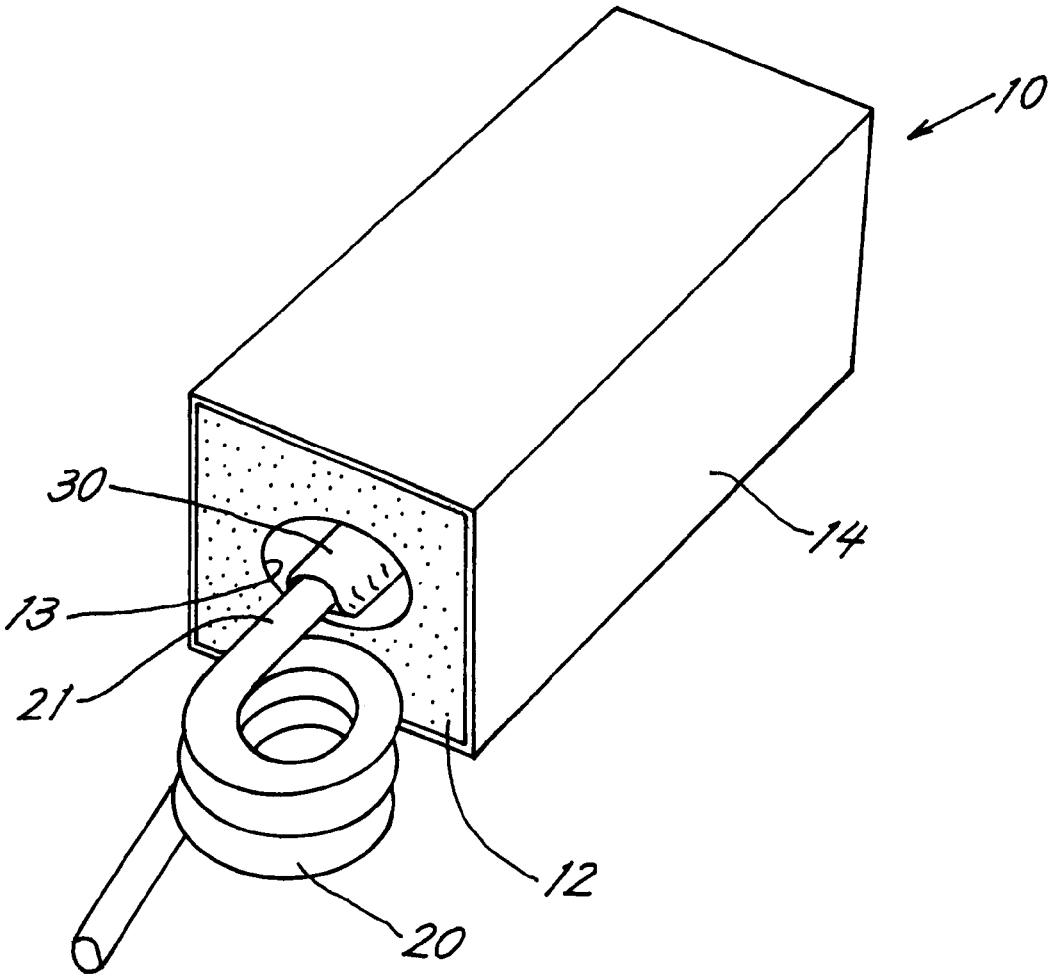
FIG. 1 is a perspective view of a ¼ wavelength coaxial resonator of the invention and a lead-equipped electric element as connected to the resonator.

FIG. 1 shows a coaxial resonator 10, which can be, for example, a ¼ wavelength coaxial resonator. As illustrated, the ¼ wavelength resonator 10 comprises a dielectric block 12 having a through-bore 13 extending through opposite end faces thereof, and a conductor layer 14 formed over the outer peripheral surface of the block 12 except one end face thereof and over the block inner surface defining the through-bore 13. This resonator causes electromagnetic waves having a wavelength equal to ¼ of the length of the resonator to resonate within the dielectric block 12. The dielectric block 12 can be prepared from a ceramic material having a high dielectric constant, such as barium oxide, titanium oxide or neodymium oxide. The conductor layer can be prepared from a material of high dielectric constant such as silver or copper.

As shown in FIGS. 1 to 4, the through bore 13 of the resonator 10 has inserted therein a lead 21 of an electric element 20 inserted therein and brazed as at 30 to the conductor layer therein. The electric element 20 is, for example, an inductance or capacitor.

Examples of useful braze filler metals are solder, solder having a high melting point, silver solder and copper solder. When usual solder (melting at about 183° C.) is used for interconnecting other elements on a substrate 70, it is desirable to use as the braze filler metal a solder having a higher melting point (about 240° C. to about 300° C.) than the solder so that the braze filler metal 30 for connecting the resonator 11 to the lead 21 will not be melted again by heating when the other elements are interconnected by brazing.

An electrically conductive adhesive (not shown) may be used instead of brazing with the braze filler metal for adhering the lead 21 to the conductor layer in the through bore 13.

Figure 2:
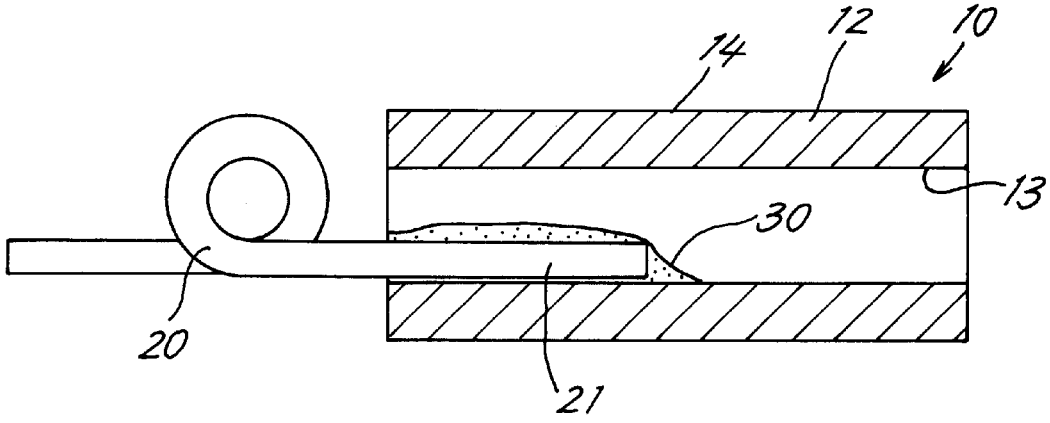
FIG. 2 is a view in section taken along a through bore of FIG. 1.
Figure 3:
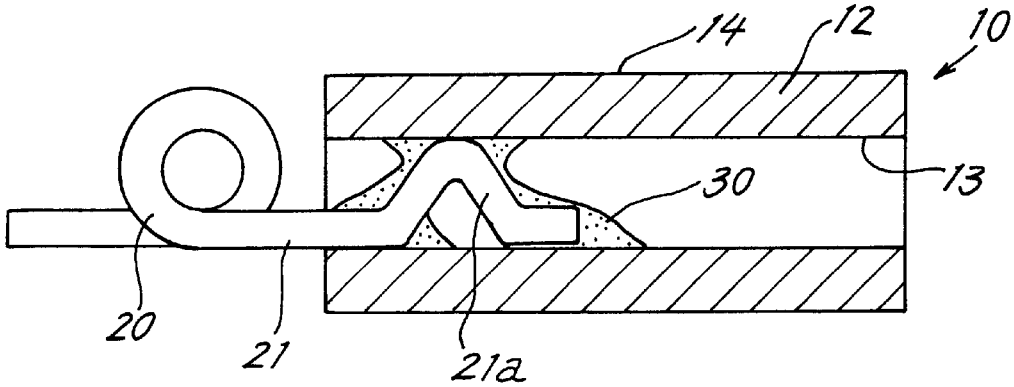
FIG. 3 is a view in section showing another embodiment of the invention.
Figure 4:
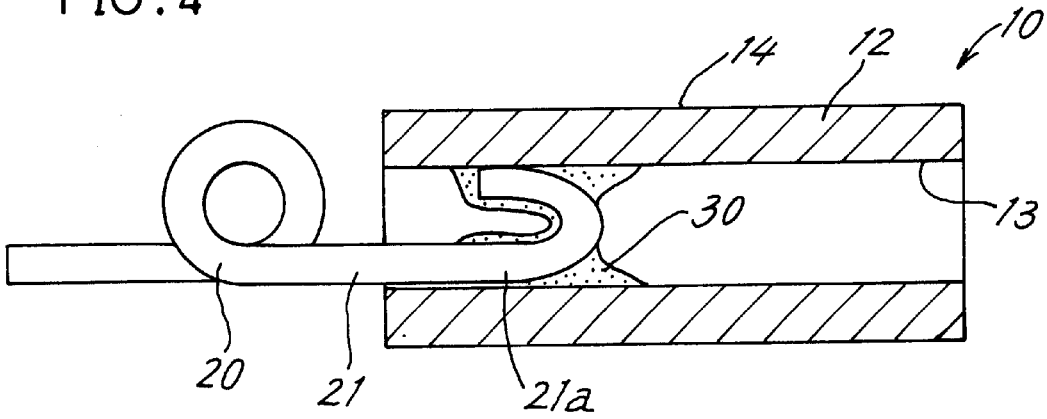
FIG. 4 is a view in section showing another embodiment of the invention.

Although the lead 21 extending straight may be inserted into the through bore 13 as shown in FIG. 2, it is desired to insert the lead 21 into the bore 13 with its forward end bent as seen in FIG. 3 or 4 so as to give an increased joint strength. In the case where the lead 21 is bent at its forward end, the bent portion 21*a* to be fitted in is given a maximum width which is preferably slightly greater than the inside diameter of the through-bore 13 so that the bent portion 21*a* will be given resistance when pushed into the bore 13 to act like a prop against the bore wall owing to an elastic restoring force. This holds the forward end of the lead 21 in pressing contact with the block inner surface defining the through bore 13 at least two portions, making it difficult for the lead 21 to slip out of the bore 13 and preventing the load 21 from wobbling when it is to be brazed or adhered to the block.

Preferably, the braze filler metal or conductive adhesive is poured into the through bore 13 before inserting the lead 21 thereinto. With molten braze filler metal 30 or the conductive adhesive applied to the forward end of the lead 21, the lead 21 may be inserted into the through bore 13.

Figure 5:
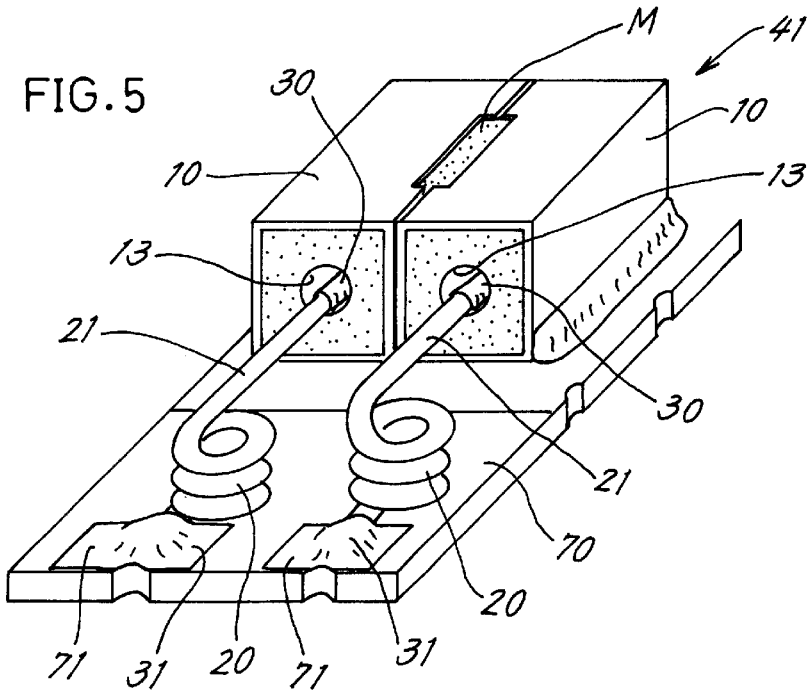
FIG. 5 is a perspective view of a dielectric filter of the invention.

As shown in FIG. 5, the resonator 10 having the lead-equipped electric element 20 connected thereto is mounted on the substrate 70 which has a conductive pattern 71 formed thereon in advance. The other end of the lead 21 of the electric element 20 can be brazed as at 31 to other element or the conductive pattern 71 with use of solder or the like.

Figure 6:
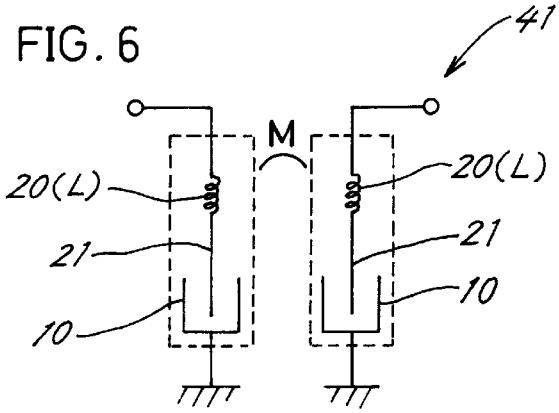
FIG. 6 is an equivalent circuit diagram of the dielectric filter of the invention
Figure 7:
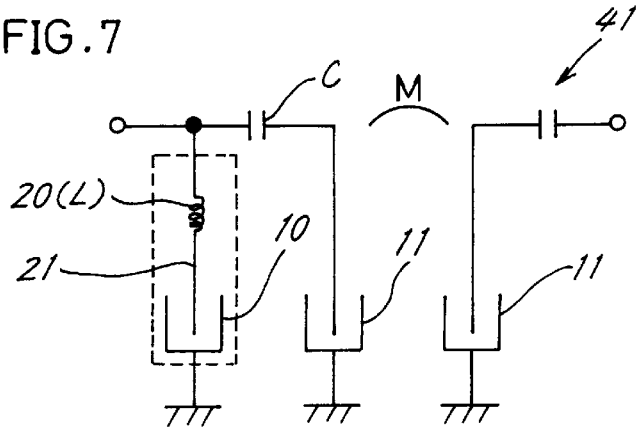
FIG. 7 is an equivalent circuit diagram of a polar dielectric filter of the invention.

FIGS. 6 and 7 are equivalent circuit diagrams of dielectric filters 41 comprising a ¼ wavelength coaxial resonator 10 of the invention. The dielectric filter 41 comprises a plurality of ¼ wavelength coaxial resonators 10, 10, or 10, 11 which are capacitance-coupled as at C, inductive-coupled and/or magnetically coupled as at M. FIG. 7 shows a polar dielectric filter.

The ¼ wavelength coaxial resonator 10 is used as at least one of the ¼ wavelength resonators 10, 11 to be mounted. According to the illustrated embodiments, the resonator 10 of the invention is used as connected in series with an inductance L (inside the dotted-line frame or frames in FIGS. 6 and 7).

After the resonator 10 of the present invention is mounted on the substrate 70, the other end of the lead 21 of the electric element 20 can be easily connected electrically, for example, to the conductive pattern 71 of the substrate 70 as by direct brazing 31 as shown in FIG. 5.

The dielectric filter 41 described can be used, for example, as a band-reject dielectric filter 42 or band-pass dielectric filter 43 of the dielectric duplexer 40 to be described below.

Figure 8:
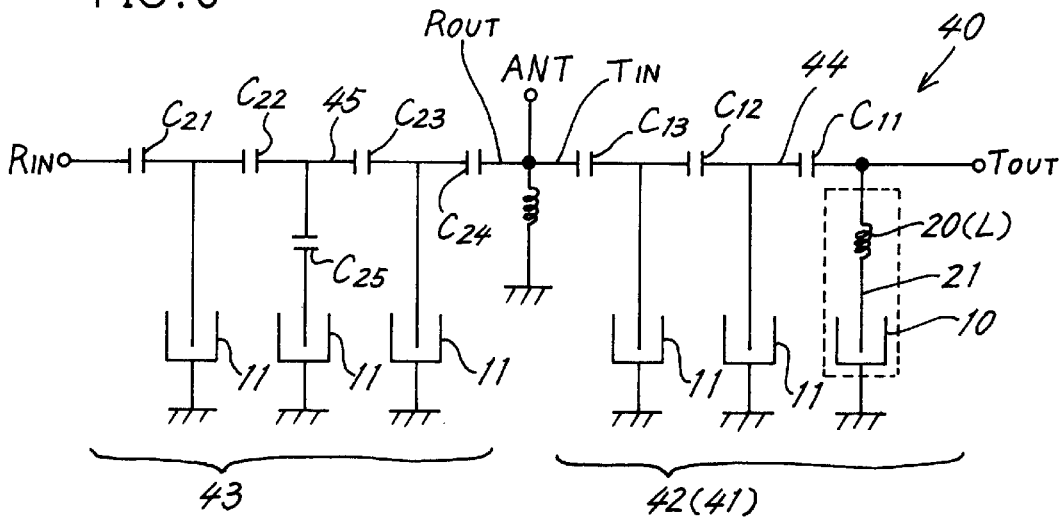
FIG. 8 is an equivalent circuit diagram of a dielectric duplexer of the invention.

FIG. 8 is an equivalent circuit diagram showing an example of dielectric duplexer 40. The duplexer 40 comprises a band-reject dielectric filter 42 on the receiving side and a band-pass dielectric filter 43 on the receiving side which are electrically connected together by a common antenna ANT.

The band-reject dielectric filter 42 comprises a plurality of coaxial dielectric resonators 10, 11, 11 which are mounted on a base substrate 70 having a conductor pattern 71 formed thereon. To describe the construction of the band-reject dielectric filter 42 with reference to the equivalent circuit diagram of FIG. 8, the filter 42 comprises ¼ wavelength coaxial resonators 10, 11, 11 arranged in parallel and capacitance-coupled by capacitors $C_{11}$, $C_{12}$ to a transmitting-side input-output line 44 provided at one end with an input terminal $T_{OUT}$ for connection to a transmitter and at the other end with an output terminal $T_{IN}$ for connection to an antenna ANT. An inductance L is connected in series with the ¼ wavelength coaxial resonator 10 close to the input terminal $T_{OUT}$. A capacitor $C_{13}$ is inserted in the input-output line 44 at the output end thereof close to the antenna ANT.

Similarly, the band-pass dielectric filter 43 comprises a plurality of coaxial dielectric resonators 11, 11, 11 which are mounted on the base substrate 70 having the conductor pattern 71 formed thereon. To describe the construction of the band-pass dielectric filter 43 with reference to the equivalent circuit diagram of FIG. 8, the filter 43 comprises coaxial resonators 11, 11, 11 arranged in parallel and capacitance-coupled by capacitors $C_{22}$, $C_{23}$ to a receiving-side Input-output line 45 provided at one end with an input terminal $R_{IN}$ for connection to an antenna ANT and at the other end with an output terminal $R_{OUT}$ for connection to a receiver. Input-output coupling capacitors $C_{21}$, $C_{24}$ are connected respectively to the input and output ends of the line 45. When the band-pass dielectric filter 43 is a polar filter having sharp attenuation characteristics, a series resonance capacitor $C_{25}$ is connected to one of the coaxial dielectric resonators.

The ¼ wavelength coaxial resonator 10 of the present invention is used as at least one of the ¼ wavelength coaxial resonators to be incorporated into the band-reject dielectric filter 42 and/or the band-pass dielectric filter 43 constituting the dielectric duplexer 40. According to the illustrated embodiment, the resonator 10 of the invention is used as one of the ¼ wavelength coaxial resonators of the band-reject dielectric filter 42 on the transmitting side (inside the dotted-line frame illustrated).

Figure 9:
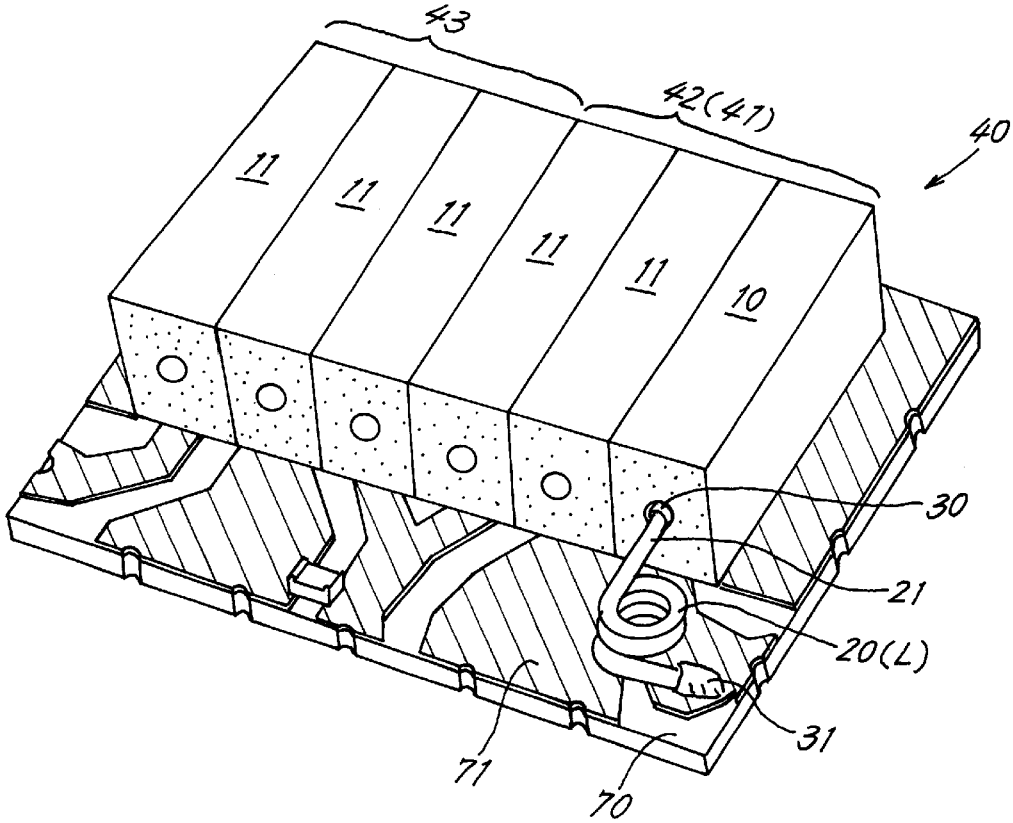
FIG. 9 is a perspective view of the dielectric duplexer of the invention.
Figure 10:
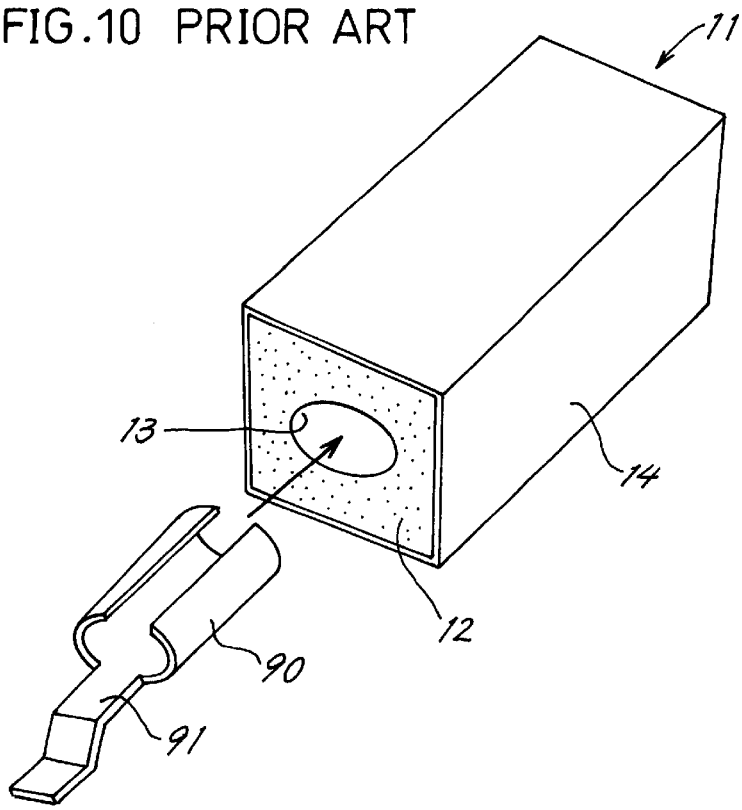
FIG.10 PRIOR ART
FIG. 10 is a perspective view showing a conventional ¼ wavelength coaxial resonator and a tubular member.
Figure 11:
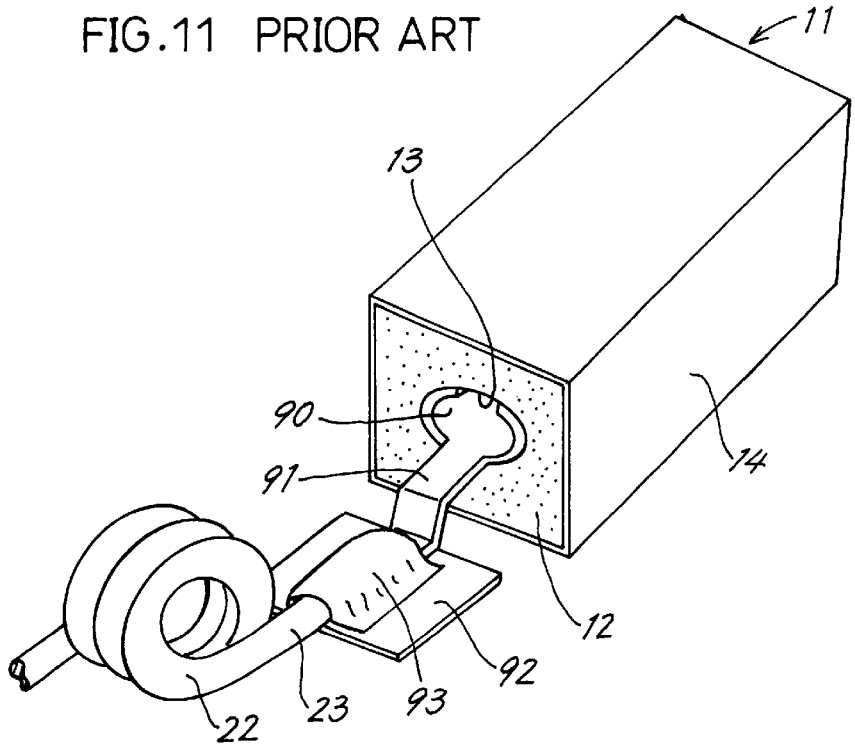
FIG.11 PRIOR ART
FIG. 11 is a perspective view of the conventional ¼ wavelength coaxial resonator and an electric element as connected thereto.

After the resonator 10 of the present invention is mounted on the substrate 70, the other end of the lead 21 of the electric element 20 can be easily connected electrically, for example, to the conductive pattern 71 of the substrate 70 as by direct brazing 31 as shown in FIG. 9.

The dielectric filter 41 and the dielectric duplexer 40 described comprise a ¼ wavelength coaxial resonator 10 which has the lead 21 of an electric element 20 connected directly to the through bore portion 13 of the resonator, so that the connection of the electric element 20 to the resonator 10 requires no conductive plate. Since the substrate need not provide a space for positioning the conductor plate, the filter 41 and the duplexer 40 can be compacted and ensure a reduction in installation space.

The coaxial resonator 10 is not limited to the ¼ wavelength coaxial resonator, while the number of resonators used for providing the dielectric filter 41 or the dielectric duplexer 40 is not limited to that used in each of the embodiments. Furthermore, the dielectric filter 41 and the dielectric duplexer 40 are not limited to the foregoing embodiments in circuit construction.

Apparently the present invention can be modified or altered by one skilled in the art without departing from the spirit of the invention. Such modifications are included within the scope of the invention as set forth in the appended claims.

What is claimed is:

1. A coaxial resonator comprising a dielectric block having a through-bore extending through opposite end faces thereof, and a conductor layer formed over an outer peripheral surface of the block except one end face thereof and over a block inner surface defining the through-bore for causing electromagnetic waves to resonate within the dielectric block, wherein a lead-equipped electric element has its lead inserted in the through-bore and electrically connected to the conductor layer over the bore-defining inner surface with a braze filler metal or electrically conductive adhesive, the lead being fixed in the through-bore, and wherein the lead is inserted in the through-bore, with a forward end of the lead bent.

2. The coaxial resonator according to claim 1, which is a ¼ wavelength coaxial resonator for causing electromagnetic waves having a wavelength equal to ¼ of the length of the resonator to resonate within the through-bore of the dielectric block.

3. A dielectric filter comprising a plurality of coaxial resonators, wherein at least one of the resonators is a coaxial resonator according to claim.

4. A dielectric duplexer comprising a band-reject filter for transmitting and a band-pass filter for receiving which are electrically connected to an antenna ANT, wherein the dielectric filter according to claim 3 is used as the band-reject filter and/or the band-pass filter.

* * * * *